US006652251B1

(12) United States Patent
Chen

(10) Patent No.: US 6,652,251 B1
(45) Date of Patent: Nov. 25, 2003

(54) ELECTRIC PUMP

(76) Inventor: Jen-Fu Chen, No. 835, Yuan Huan East Road., Feng Yuan City, Taichung Hsien (TW)

( * ) Notice: Subject to any disclaimer, the term of this patent is extended or adjusted under 35 U.S.C. 154(b) by 0 days.

(21) Appl. No.: 10/163,118

(22) Filed: Jun. 6, 2002

(51) Int. Cl.[7] ..... F04B 17/00; A23B 3/12

(52) U.S. Cl. ..... 417/411; 417/422; 417/571; 99/472; 141/65

(58) Field of Search ..... 417/411, 422, 417/557, 571; 220/202, 203.1; 215/260, 262; 99/472; 141/65

(56) References Cited

U.S. PATENT DOCUMENTS 4,021,150 A * 5/1977 Mabuchi ..... 417/411
4,984,611 A * 1/1991 Takatsuki et al. ..... 141/65
5,195,427 A * 3/1993 Germano ..... 99/472
5,390,809 A * 2/1995 Lin ..... 220/212
5,405,038 A * 4/1995 Chuang ..... 220/231
5,779,082 A * 7/1998 Miramon ..... 220/212
5,964,255 A * 10/1999 Schmidt ..... 141/65
6,422,835 B1 * 7/2002 Beauchard ..... 417/411
6,470,924 B2 * 10/2002 Chen ..... 141/65
6,520,071 B1 * 2/2003 Lanza ..... 99/472

* cited by examiner

*Primary Examiner*—Cheryl J. Tyler
*Assistant Examiner*—Michael K. Gray
(74) *Attorney, Agent, or Firm*—Charles E. Baxley

(57) ABSTRACT

An electric pump includes a cylinder, a pumping element, a cap and a spring. The cylinder defines a space and at least one aperture in communication with the space and includes a first end defining an aperture and a second end defining an opening. The pumping element is received in the cylinder for pumping air through the aperture defined in the first end of the cylinder, the space and the at least one aperture. The battery includes a first electrode and a second electrode, and is received in the cylinder so that the first electrode is in electric connection with the pumping element. The cap is engaged with the second end of the cylinder. The spring is attached to the cap. The spring is in electric connection with the pumping element. The cap includes an OFF position where the spring is off the second electrode and an ON position where the spring is in connection with the second electrode. A tubular joint is secured to the first end of the cylinder. The tubular joint includes an end secured to the first end of the cylinder. An annular seal is formed on the tubular joint. The cylinder includes a thread formed on the second end thereof. The cap includes a thread formed on an internal face for engagement with the thread of the cylinder.

6 Claims, 5 Drawing Sheets

ELECTRIC PUMP

BACKGROUND OF INVENTION

1. Field of Invention

The present invention relates to an electric pump and, more particularly, to an electric pump for causing a vacuum in a container.

2. Related Prior Art

Many people enjoy drinking coffee. They buy coffee from shops or buy coffee beans or powder from shops and make coffee at home. Coffee beans or powder and sugar to go with coffee must be stored carefully and namely kept from humidity. A way to keep them from humidity is to put them in vacuum storage devices.

A conventional storage device includes a container, a lid for sealing the container, an outlet check valve mounted on the lid, an inlet check valve mounted on the lid and a manual pump. In use, things are put in the container. The container is covered by means of the lid. The manual pump is engaged with the outlet check valve and operated in order to pump air from the container through the outlet check valve. Thus, a low pressure is caused in the container in order to preserve the tings for a long time. However, several problems have been encountered in use of this conventional vacuum storage device. Firstly, the manual pump must be operated with a certain degree of effort. Secondly, the manual pump must be operated for a certain period of time so as to cause an adequate vacuum in the container. Third, the manual pump cannot be operated with a single hand.

The present invention is therefore intended to obviate or at least alleviate the problems encountered in prior art.

SUMMARY OF THE INVENTION

It is an objective of the present invention to provide an electric pump for a vacuum storage device including a container, a lid for sealing the container, an outlet check valve mounted on the lid and an inlet check valve mounted on the lid.

According to the present invention, an electric pump includes a cylinder, a pumping element, a cap and a spring. The cylinder defines a space and at least one aperture in communication with the space and includes a first end defining an aperture and a second end defining an opening. The pumping element is received in the cylinder for pumping air through the aperture defined in the first end of the cylinder, the space and the at least one aperture. The battery includes a first electrode and a second electrode, and is received in the cylinder so that the first electrode is in electric connection with the pumping element. The cap is engaged with the second end of the cylinder. The spring is attached to the cap. The spring is in electric connection with the pumping element. The cap includes an OFF position where the spring is off the second electrode and an ON position where the spring is in connection with the second electrode.

A tubular joint is secured to the first end of the cylinder.

The tubular joint includes an end secured to the first end of the cylinder.

An annular seal is formed on the tubular joint.

The cylinder includes a thread formed on the second end thereof. The cap includes a thread formed on an internal face for engagement with the thread of the cylinder.

Other objects, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
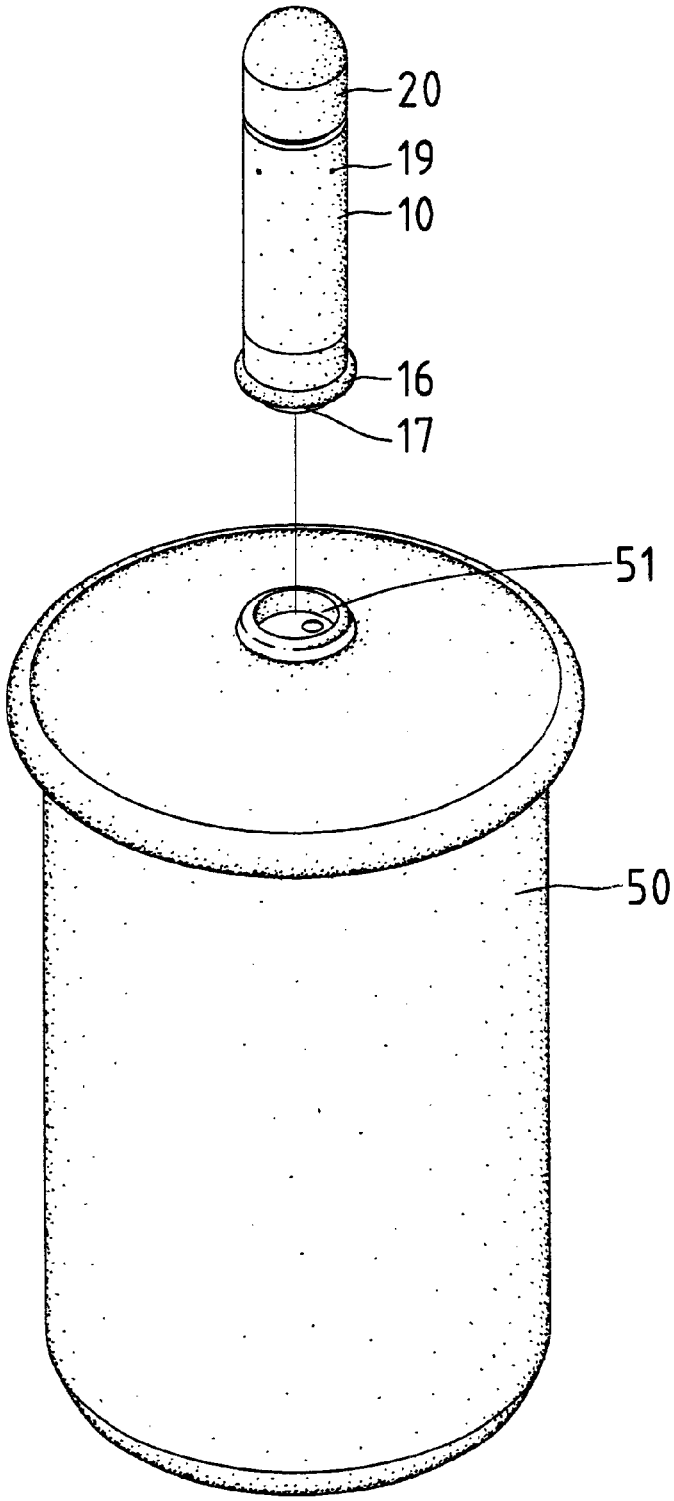
FIG. 1 is a perspective view of an electric pump for a vacuum storage device according to the present invention.
Figure 2:
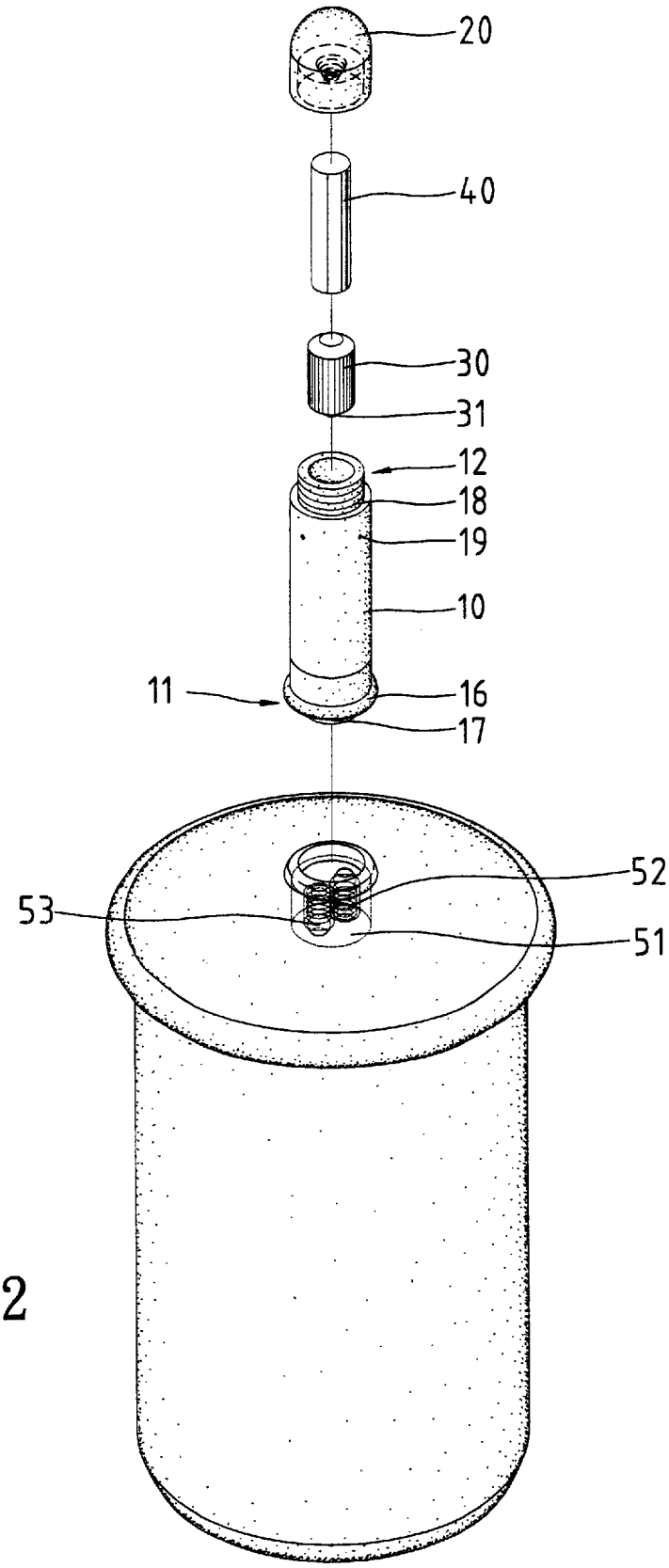
FIG. 2 is an exploded view of the electric pump shown in FIG. 1.
Figure 3:
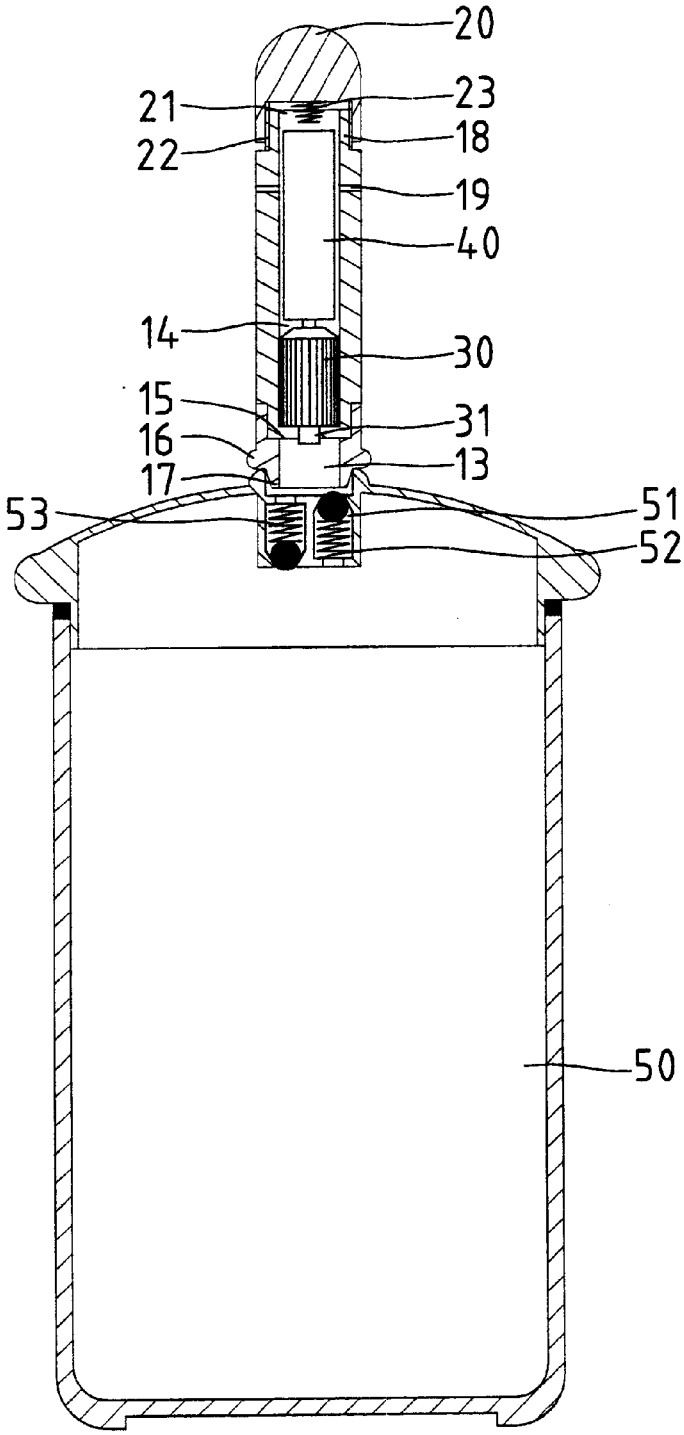
FIG. 3 is a cross-sectional view of the electric pump shown in FIG. 1.
Figure 4:
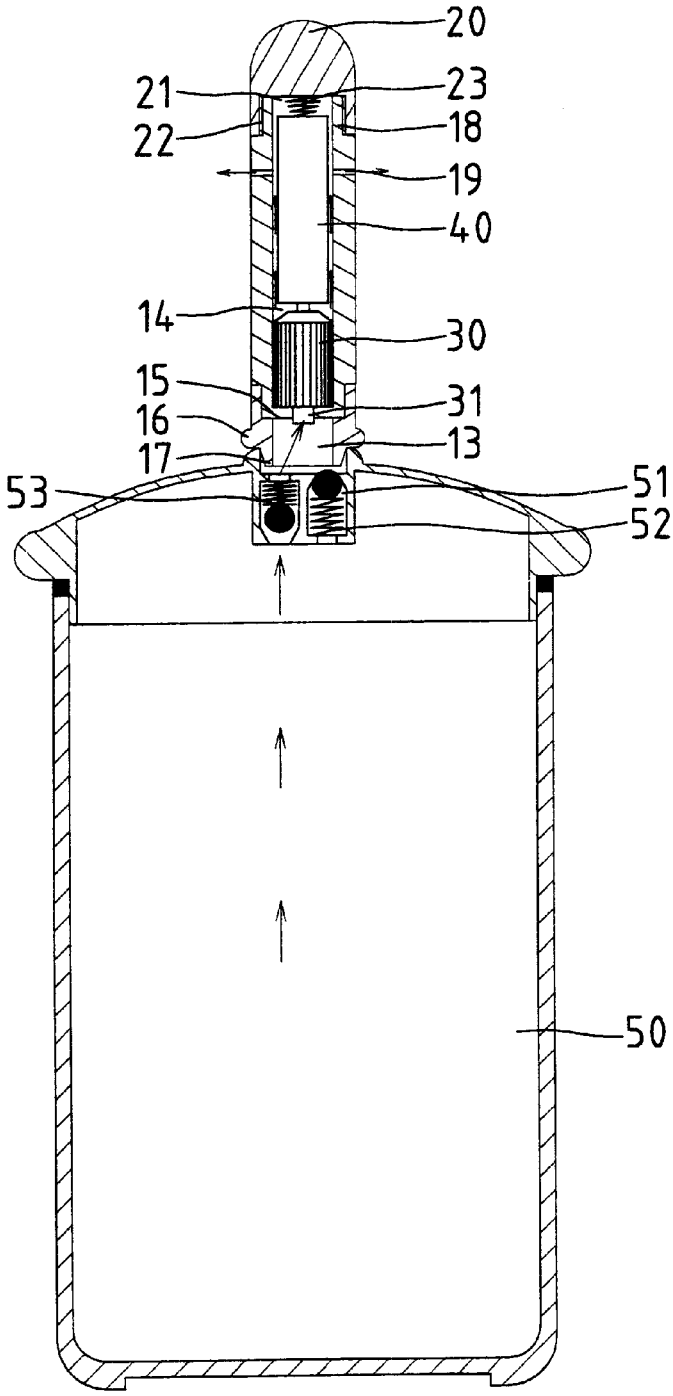
FIG. 4 is similar to FIG. 3 and shows air pumped from the storage device.
Figure 5:
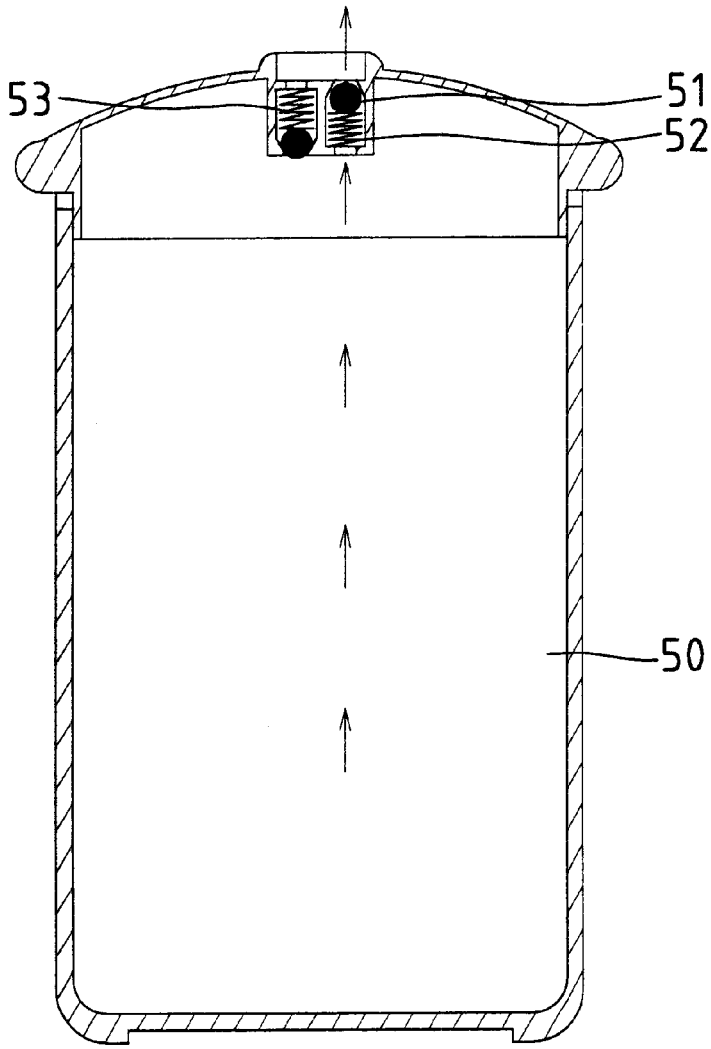
FIG. 5 is a cross-sectional view of the vacuum storage device shown in FIG. 1 and shows air flowing into the vacuum storage device.

Referring to FIGS. 1~5, an electric pump is provided according to the preferred embodiment of the present invention for a vacuum storage device.

The vacuum storage device includes a container 50, a lid 51 for sealing the container 50, an outlet check valve 53 mounted on the lid 51, an inlet check valve 52 mounted on the lid 51 and an annular lip 54 formed on the lid 51. The check valves 52 and 53 are located within the annular lip 54.

The electric pump includes a cylinder 10 including a first end 11 and a second end 12 11 and defining a space 14. The cylinder 10 includes an annular shoulder 15 formed at the first end 11 thereof and a thread 18 formed near the second end 12 thereof. The cylinder 10 defines a plurality of apertures 19 in communication with the space 14. The cylinder 10 includes A tubular joint defines a space 13 and includes an end secured to the first end 11 of the cylinder 10, an intermediate section formed with annular seal 16 and a tapered opposite end 17. The space13 is in communication with the space 14.

An electric pumping element 30 is received in the space 14. The electric pumping element 30 is conventional and therefore will not be further described in detail.

A battery 40 is received in the space 14 so that a positive electrode thereof is in direct contact with the electric pumping element 30.

A cap 20 defines a space 21 and includes an internal face on which a thread 22 is formed. The thread 22 is engaged with the thread 18, thus keeping the pumping element 30 and the battery 40 in the space 14. A spring 23 is attached to the internal face of the cup 20 in order to provide elasticity and conductivity.

Although not shown, a conductive element is received in the space 14. The conductive element includes an end in contact with the pumping element 30 and another end for contact with the spring 23.

In use, things are put in the container 50. The cover 50 is covered and sealed by means of the lid 51. The tapered end 17 is inserted into a space defined in the annular lip 54, and the annular seal 16 is pressed against the annular lip 54. The cap 20 is rotated on the cylinder 10 so as to move the spring 23 into contact with the conductive element, thus forming a closed circuit for driving the pumping element 30. Thus, air is pumped by means of the pumping element 30 from the container 50 through the outlet check valve 53 in order to cause in the container 50 an adequate vacuum useful for preservation of things.

To remove the things from the container 50, the inlet check valve 52 is operated in a conventional manner in order to permit air into the container 50 from the atmosphere through the inlet check valve 52 until the pressure in the atmosphere is equal to the pressure in the container 50.

The present invention has been described through detailed illustration of the preferred embodiment. Those skilled in the art can derive many variations from the preferred embodiment without departing from the scope of the present invention. Therefore, the preferred embodiment shall not limit the scope of the present invention. The scope of the present invention is defined in the attached claims.

What is claimed is:

1. An electric pump including:

a cylinder (10) defining a space (14) and at least one aperture (19) in communication with the space (14) and including a first end (11) defining an aperture and a second end (12) defining an opening;

a pumping element (30) received in the cylinder (10) for pumping air through the aperture defined in the first end (11) of the cylinder (10), the space (14) and the at least one aperture (19);

a battery (40) that includes a first electrode and a second electrode, and is received in the cylinder (10) so that the first electrode is in electric connection with the pumping element (30);

a cap (20) engaged with the second end (12) of the cylinder (10); and a spring (23) that is attached to the cap (20), and is in electric connection with the pumping element (30), wherein the cap (20) includes an OFF position where the spring (23) is off the second electrode and an ON position where the spring (23) is in connection with the second electrode.

2. The electric pump according to claim 1 including a tubular joint secured to the first end (11) of the cylinder (10).

3. The electric pump according to claim 2 wherein the tubular joint includes an end secured to the first end (11) of the cylinder (10) and a tapered opposite end (17).

4. The electric pump according to claim 3 wherein the tubular joint includes an annular seal (16) formed thereon.

5. The electric pump according to claim 1 wherein the cylinder (10) includes a thread (18) formed on the second end (12) thereof and the cap (20) includes a thread (22) formed on an internal face for engagement with the thread (18) of the cylinder (10).

6. A vacuum storage device including:

a container (50);

a lid (51) for sealing the container (50);

an outlet check valve (53) mounted on the lid (51);

an inlet check valve (52) mounted on the lid (51);

an annular lip (54) formed on the lid (51), wherein the check valves (52, 53) are located within the annular lip (54);

a cylinder (10) defining a space (14) and at least one aperture (19) in communication with the space (14) and including a first end (11) defining an aperture for engagement with the annular lip (54) and a second end (12) defining an opening;

a pumping element (30) received in the cylinder (10) for pumping air through the aperture defined in the first end (11) of the cylinder (10), the space (14) and the at least one aperture (19);

a battery (40) that includes a first electrode and a second electrode, and is received in the cylinder (10) so that the first electrode is in electric connection with the pumping element (30);

a cap (20) engaged with the second end (12) of the cylinder (10); and a spring (23) attached to the cap (20) in electric connection with the pumping element (30), wherein the cap (20) includes an OFF position where the spring (23) is off the second electrode and an OFF position where the spring (23) is in connection with the second electrode.

* * * * *